United States Patent [19]

Wise

[11] Patent Number: 4,610,627

[45] Date of Patent: Sep. 9, 1986

[54] HIGH VELOCITY, EVEN FLOW FLAME TREATMENT OF WEBS

[76] Inventor: Walter G. Wise, 226 North Traub, Indianapolis, Ind. 46222

[21] Appl. No.: 677,861

[22] Filed: Dec. 4, 1984

[51] Int. Cl.[4] ..... F27B 9/28; C21D 9/54; F23D 14/62

[52] U.S. Cl. ..... 432/8; 266/103; 431/354; 432/59

[58] Field of Search ..... 432/8, 14, 59; 431/354; 266/103

[56] References Cited

U.S. PATENT DOCUMENTS

| | | | |
|---|---|---|---|
| 3,334,820 | 8/1967 | Flynn | 431/349 |
| 3,390,465 | 7/1968 | Wise | 34/23 |
| 3,501,098 | 3/1970 | Evans | 431/354 |
| 3,640,788 | 2/1972 | Flynn | 156/82 |
| 3,870,461 | 3/1975 | Wise | 432/11 |

*Primary Examiner*—John J. Camby

*Attorney, Agent, or Firm*—Woodard, Weikart, Emhardt & Naughton

[57] ABSTRACT

An apparatus and method for flame treating a material web. A burner comprising a tube within a tube construction with the tubes spaced apart to form a heat sink chamber. The burner produces a continuous lean flame of relatively high velocity and is designed to minimize thermal bow along the length of the burner. The burner is mounted to a frame and is positioned to have a continuous flame extending therefrom toward the material web. The burner treats all the facing web surface while minimizing the uneven treatment of the web.

17 Claims, 3 Drawing Figures

HIGH VELOCITY, EVEN FLOW FLAME TREATMENT OF WEBS

BACKGROUND OF THE INVENTION

1. Field of the Invention

This invention relates to the flame treating of a material web.

2. Description of the Prior Art

The flame treating of a material web to facilitate adherence of another substance to the web is well known.

Wise, U.S. Pat. No. 3,870,461 discloses an apparatus and method for flame treating in which gas is mixed with sufficient air prior to ignition to insure complete combustion and an intense and lean flame with no flame wrap around or unignited gas imbedded in the web material.

Wise U.S. Pat. No. 3,390,465 discloses heat treating of a moving web having a surface coating dried thereon and using an abundance of air to wipe off volatile by-products.

U.S. Pat. No. 3,640,788 discloses a method of flame treatment utilizing a stiff flame fed by a combustible mixture of gas and air at a ratio to obtain substantially complete combustion of the mixture at the flame tip.

A problem experienced with many of the prior art devices has been thermal bow along the length of the burner. Such bow results in uneven flame positioning across the web and thus, uneven flame treatment of the web.

One approach, such as disclosed in U.S. Pat. No. 3,411,717 is the use of water tubes running adjacent and parallel to the length of burner to produce a more equal temperature along the length of the burner thereby minimizing the bow.

The burner disclosed herein is designed to minimize the thermal bow along the length of the burner. The tube within a tube construction of the burner in the present invention provides longitudinal rigidity to the burner. Further, a heat sink chamber is formed within the burner holding the fuel mixture flowing from the outlets of the inner tube and allowing heat transfer from the portion of the outer tube adjacent the chamber into the mixture reducing the temperature of the outer tube while minimizing the temperature differences of portions of the outer tube.

Many of the prior art devices provide for continuously feeding a material web at relatively high speed to and past a burner which directs a flame fed by a combustible mixture of gas and air. A major disadvantage of many of the prior art devices is that the burner often produces a flame of uneven intensity, resulting in the flame contacting only a portion of the web and unevenly treating the web. One approach, such as disclosed in U.S. Pat. No. 3,334,820 is the use of gas burners with selective flame distribution so as to obtain fairly uniform heat conditions along the length of the material web. The burner disclosed herein is designed to produce a lean flame of relatively high velocity thereby treating all the facing web surface minimizing the uneven treatment of the web.

Another problem of many of the prior art devices is that the material web is traveling at so substantial a velocity relative to the flame velocity to result in the web pulling the flame downstream as the web travels along its path and as a result of the flame dwelling on the web, the web material may become brittle. The present invention seeks to minimize the damage of flame/web dwell by moving the web past the flame at a web velocity equal to or greater than a minimum high velocity of the gas/air mixture.

SUMMARY OF THE INVENTION

One embodiment of the present invention is a burner for flame treating a material web operable on a gas/air fuel mixture comprising a first elongated tube with a first cross section and a first longitudinal axis, the first tube adaptable to receive a gas/air fuel mixture, the first tube having a plurality of outlets to permit a volume of the fuel mixture to escape through the outlets, a second elongated tube with a second cross section and a second longitudinal axis, the first tube situated within the second tube but spaced apart therefrom at the location of the first tube's outlets forming a heat sink chamber to hold the fuel mixture flowing from the outlets and allowing transfer of heat from the second tube into the fuel mixture reducing the temperature of the second tube, the second thube having a plurality of ports to allow the fuel mixture to escape from the heat sink chamber.

Another embodiment of the present invention is a method of flame treating a material web facilitating adherence to the web comprising the steps of providing an elongated tube with length and ports along the length, premixing sufficient air with gas to insure virtual complete combustion of the gas, forcing a gas/air mixture through the ports of the tube at a minimum high velocity, igniting the mixture to produce a flame along the length of the tube, directing the flame toward and adjacent the material web to directly treat the web with the flame while the web moves across the flame and moving the web past the flame at a web velocity equal to or greater than the minimum high velocity of the mixture controlling the position of the flame to treat substantially all flame facing surface of the web while minimizing flame/web dwell.

It is an object of this invention to provide an improved method for flame treating a material web.

Another object of the present invention is to provide a new and improved flame treating apparatus.

Yet another object of the present invention is to provide a burner for flame treating a web without thermal bow existing in the burner.

A further object of the present invention is to provide a high velocity and lean flame for treating a web.

Further objects and advantages of the present invention will be apparent in the following detailed description taken in conjunction with the appended claims.

DESCRIPTION OF THE PREFERRED EMBODIMENT

Figure 1:
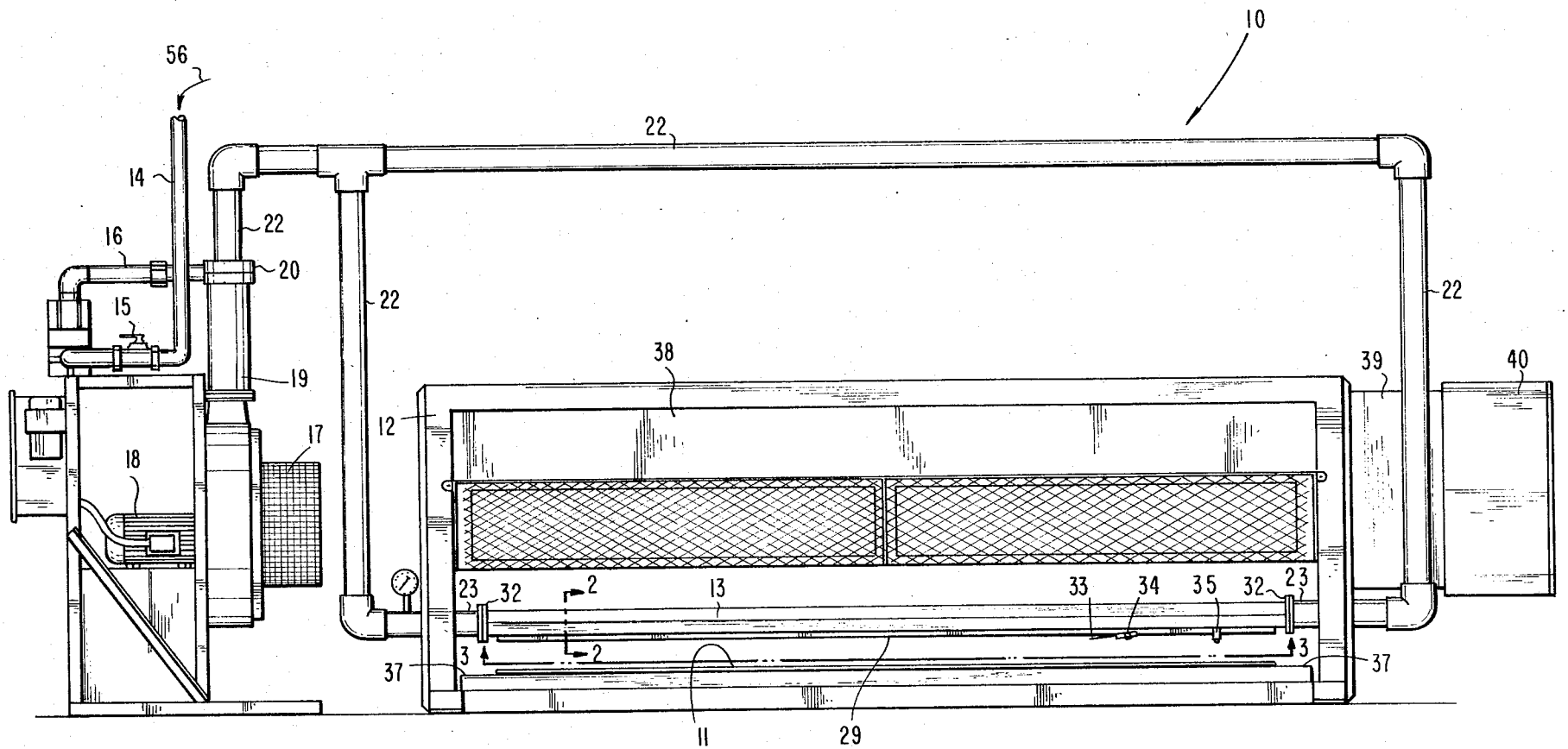
FIG. 1 is a side view of an apparatus incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown an apparatus 10 for flame treating a material web 11. Apparatus 10 includes a main frame 12 with burner 13 mounted thereon.

Pipe 14 is connected to a supply of pressurized gas 56 and via flow control valve 15 to gas conduit 16. Air filter 17 is connected to air compressor 18 which sucks atmospheric air through the filter and then forces the air through air pipe 19. A venturi housing 20 is mounted on air pipe 19 with the air within air pipe 19 flowing through an aperature into venturi housing 20. Venturi housing 20 is also in communication with gas conduit 16. The desired amounts of air and gas are mixed in the venturi housing and then routed out through gas/air conduit 22. Gas/air conduit 22 is connected to burner 13 at burner inlets 23, the gas/air mixture being the fuel on which the burner operates. The gas/air ratio may range from 10 parts air: 1 part gas to 30 parts air: 1 part gas. The velocity of the fuel mixture may range from 1000 feet per minute to 100,000 feet per minute.

Figure 2:
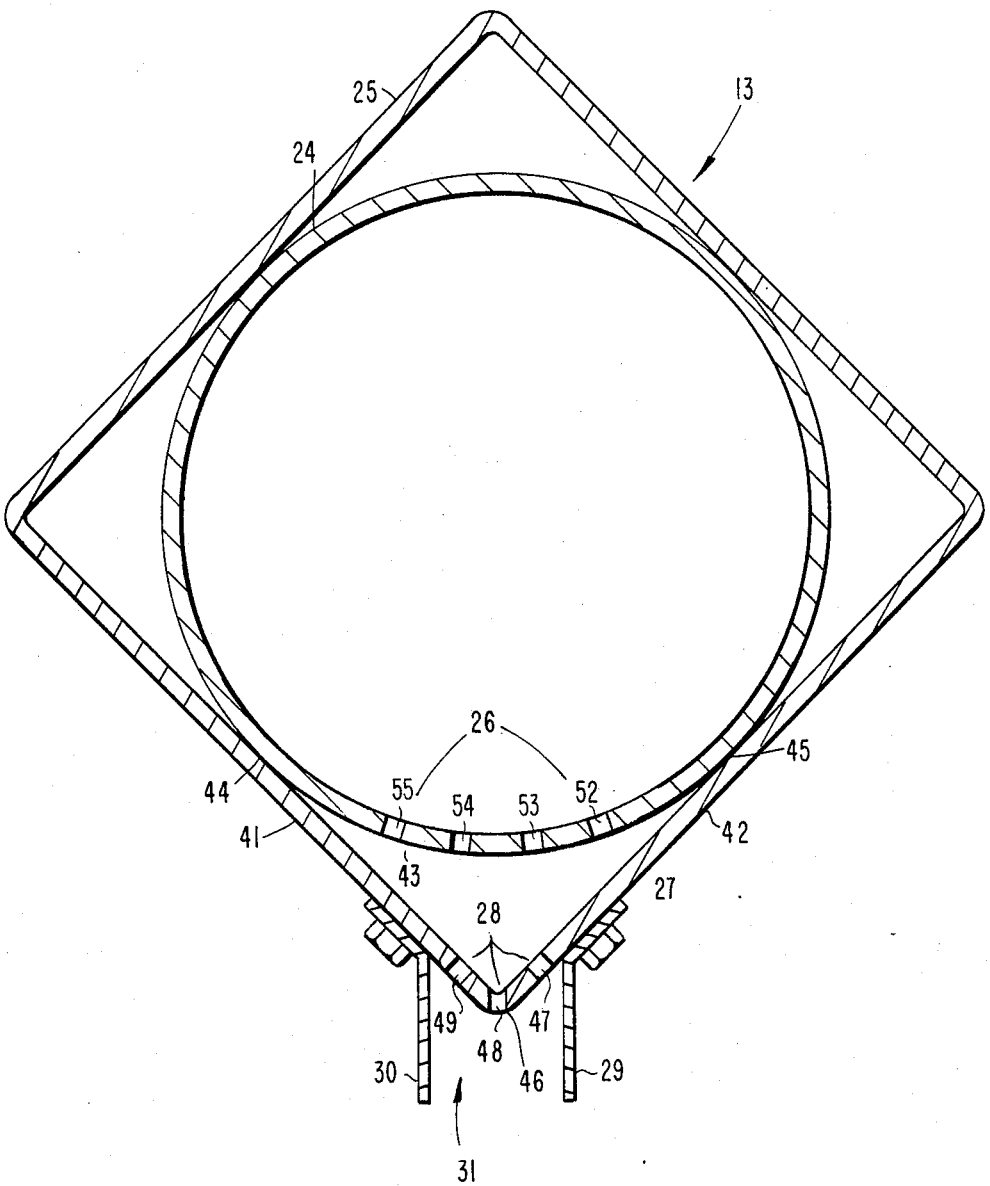
FIG. 2 is an enlarged cross sectional view of the burner taken along the line 2—2 of FIG. 1 and viewed in the direction of the arrows.
Figure 3:
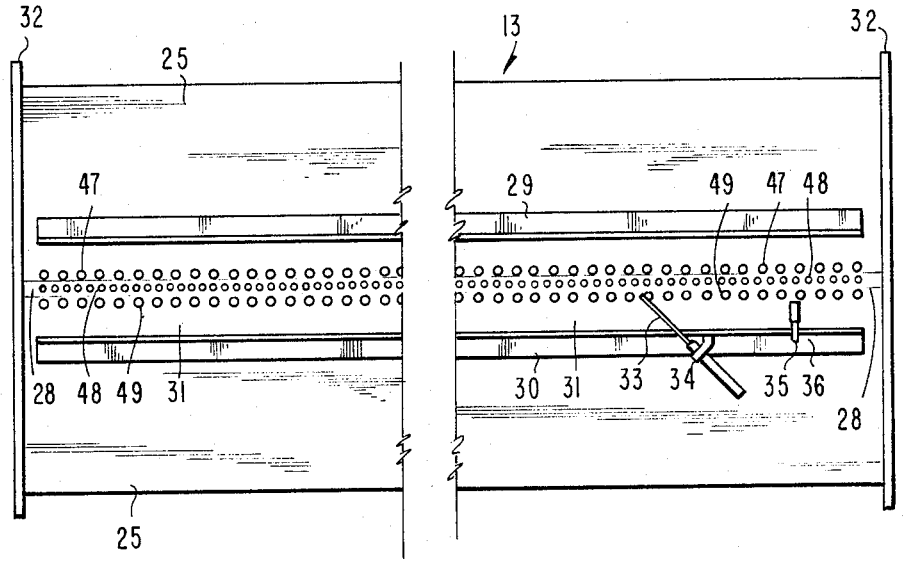
FIG. 3 is a fragmentary bottom view of the burner taken along the line 3—3 of FIG. 1 and viewed in the direction of the arrows.

Burner 13 will now be described, reference is made to FIG. 1 taken in conjunction with FIG. 2 and FIG. 3. The main body of burner 13 comprises liner tube 24 with circular cross section situated within outer tube 25 with square cross section. Liner tube 24 has a pair of opposite inlets 23 connected to conduit 22 to receive the gas/air fuel mixture. Liner tube 24 has a plurality of outlets 26 along its longitudinal axis to permit a volume of the fuel mixture to escape through the outlets 26. Outlets 26 comprise four parallel rows of holes of uniform dimension 52, 53, 54 and 55. Outer tube 25 is spaced apart from liner tube 24 forming a heat sink chamber 27 to hold the fuel mixture flowing through the outlets 26. Heat sink chamber 27 is formed by portions 41 and 42 of outer tube 25 and portion 43 of liner tube 24. The portions 41, 42 and 43 are defined by the points of contact 44 and 45 of liner tube 24 with outer tube 25 and the corner 46 where portions 41 and 42 approach each other. Rows 52, 53, 54 and 55 are within portion 43 of liner tube 24. Heat sink chamber 27 permits transfer of heat from outer tube 25 into the mixture within the chamber 27 thereby reducing the temperature existing at corner 46 of outer tube 25. Outer tube 25 has a plurality of ports 28 at corner 46 to allow the mixture to escape from the chamber 27. Outer tube 25 is secured to liner tube 24 by any means, such as, a bolt extending through one corner of tube 25 and into tube 24.

Chamber 27 provides a reservoir of a gas/air mixture extending essentially at an equal pressure across the length of the burner. As a result, the mixture escapes through ports 28 at the same high velocity across the length of the burner. Without chamber 27 and if fed from the opposite ends, the air/gas mixture would be at a low pressure at the opposite ends of the burner but at a high pressure at the middle of the burner thereby providing a low velocity flame at the burner ends but a high velocity flame in the center portion. If fed from one end only then the highest flow rate would be at the end opposite of the feed end.

Many configurations of ports 28 and outlets 26 are contemplated and included in the present invention. A sufficient number of outlets 26 are provided relative to ports 28, in a non-aligned configuration, to insure that chamber 27 is in operation always filled with mixture at sufficient pressure to provide even flow through ports 28. In one embodiment the mixture flowed through the liner tube's outlets at a velocity of 2000 feet per minute and through the outer tube's ports at a velocity of 12,000 feet per minute.

The burner 13 in addition comprises a pair of opposite flame directing walls 29 and 30 on tube 25 with the ports 28 extending therebetween. Walls 29 and 30 are spaced apart forming a row 31 in which the gas/air fuel mixture burns when ignited to produce a flame. Ports 28 comprise three parallel rows of holes 47, 48 and 49 within row 31 of tube 25. The rows of holes 47 and 49 are closest to the flame directing walls 29 and 30 respectively, and are of uniform dimension and spacing. Holes 48 are centered in row 31 between holes 47 and 49. Holes 48 while being of uniform dimension and spacing are more closely spaced than holes 47 and 49. Holes 47 and 49 each have a central axis at approximately a 90° angle to the central axis of holes 48. Flame directing walls 29 and 30 are fixedly mounted to outer tube 25 for compressing the mixture flowing outwardly from the ports 28 thereby increasing the forward velocity of the flame and providing increased heat transfer to the material web 11 moving beneath the flame. Likewise, walls 29 and 30 are heated by the flame causing corner 46 to rise in temperature. Portions 41 and 42 thereby are heated but transfer heat into the mixture within chamber 27 minimizing the difference in temperature between corner 46 and the diagonally opposite corner of outer tube 25 preventing thermal bow of the burner.

Outer tube 25 is mounted in between and secured to a pair of flanged walls 32 enclosing the opposite ends of chamber 27. A conventional sensor 33 is mounted to bracket 34 secured to main frame 12. Burner 13 is provided with a conventional ignitor which may be similar to a spark plug. For example, burner 13 is provided with ignitor 35 for the automatic ignition of the flame. Ignitor 35 is mounted to bracket 36 secured to main frame 12.

Conveying means 37 (FIG. 1) are provided to support and convey the material web past the flames. The conveying means may include a plurality of rollers.

A hood 38 comprising, a portion of main frame 12 is connected via duct 39 to exhaust fan 40 and is operable to allow the removal of exhaust fumes.

The material web is moved past the flame at a web velocity equal to or greater than the minimum high velocity at which the gas/air mixture is forced from ports 28 to minimize the danger and damage of flame/-web dwell. Factors to be considered in determining the minimum high velocity of the gas/air mixture include: forcing a gas/air mixture from ports extending along the length of the elongated tube under sufficient pressure to produce a continuous flame extending the length of the tube, treating substantially all surface irregularities of the material web and the desire to move and treat the material web economically and as quickly as possible. In one embodiment the mixture flowed from ports at a minimum high velocity of 1000 feet per minute.

The apparatus and method disclosed herein is particularly useful in coalting aluminum foil or paper with plastic. In addition, the apparatus and method disclosed herein is useful in flame treating materials such as burlap. Likewise, the invention disclosed herein may be utilized to flame treat plastic so that ink and water will adhere without necessitating the use of a solvent. Likewise, a glue and water mixture can be applied to the treated plastic since upon flame treatment the water is evaporated. Further, the invention may be used to pretreat clay coated papeer to bond plastic.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, various gas/air ratios may be utilized; however, the best results have been attained for obtaining a lean, sharp, blue flame by fully aerating the fuel in accordance with the following ratios:

| GAS | PARTS OF GAS/PARTS OF AIR |
|---|---|
| Natural | 1/10 |
| Propane | 1/25 |
| Butane | 1/32 |

The fuel mixture exiting ports 28 may be examined to determine the quality of the fuel mixture. Flow control valve 15 is operable to obtain a ratio of gas to air to provide a lean fuel mixture.

Many variations are contemplated and included in the present invention. For example, a partition wall may be mounted in outer tube 25 in lieu of providing liner tube 24 in order to form chamber 27.

I claim:

1. A device for treating material with a high velocity flame operable on a gas/air fuel mixture comprising:

a tube with a longitudinal axis and a partition along said longitudinal axis, said partition dividing said tube into a first chamber and a second chamber, said partition providing thermal bow resisting longitudinal structural integrity to said tube, said first chamber connectable to a source of said mixture, said first chamber having a plurality of outlets extending through said partition to permit a volume of said mixture to flow from said first chamber into said second chamber, said second chamber providing a reservoir for said mixture at essentially the same pressure along said longitudinal axis, said second chamber having a plurality of ports extending along said longitudinal axis to allow said mixture to escape from said device at essentially the same minimum high velocity along said longitudinal axis, said mixture forming an elongated strip of gas and air escaping through said ports.

2. The device of claim 1 in addition comprising:

a pair of opposite flame directing walls on said tube with said ports extending therebetween, said walls are spaced apart forming a row, said walls compress said mixture flowing outwardly from said ports to increase the forward velocity of said mixture.

3. The device of claim 1 wherein said first chamber is formed by a first elongated tube with a first cross section and a first longitudinal axis and said second chamber is formed by a second elongated tube with a second cross section and second longitudinal axis, said ports extending along said second longitudinal axis.

4. The device of claim 3 in addition comprising:

a pair of opposite flame directing walls on said second elongated tube with said ports extending therebetween, said walls are spaced apart forming a row, said walls compress said mixture flowing outwardly from said ports to increase the forward velocity of said mixture.

5. A device for treating material with a high velocity flame operable on a gas/air fuel mixture comprising:

a tube with a longitudinal axis and a partition along said longitudinal axis, said partition dividing said tube into a first chamber and a second chamber, said first chamber connectable to a source of said mixture, said first chamber having a plurality of outlets extending through said partition to permit a volume of said mixture to flow from said first chamber into said second chamber, said second chamber providing a reservoir for said mixture at essentially the same pressure along said longitudinal axis, said second chamber having a plurality of ports extending along said longitudinal axis to allow said mixture to escape from said device at essentially the same minimum high velocity along said longitudinal axis, said mixture forming an elongated strip of gas and air escaping through said ports;

and wherein said first chamber is formed by a first elongated tube with a first cross section and a first longitudinal axis and said second chamber is formed by a second elongated tube with a second cross section and second longitudinal axis, said ports extending along said second longitudinal axis;

and wherein said first elongated tube is situated within said second elongated tube but spaced apart therefrom at the location of said outlets forming said reservoir.

6. The device of claim 5 in addition comprising:

a pair of opposite flame directing walls on said second elongated tube with said ports extending therebetween, said walls are spaced apart forming a row, said walls compress said mixture flowing outwardly from said ports to increase the forward velocity of said mixture.

7. A burner for flame treating a material web operable on a gas/air fuel mixture comprising:

a tube with a longitudinal axis and a partition along said longitudinal axis, said partition dividing said tube into a first chamber and a second chamber, said partition providing thermal bow resisting longitudinal structural integrity to said tube, said first chamber connectable to a source of said mixture, said first chamber having a plurality of outlets extending through said partition to permit a volume of said mixture to flow from said first chamber into said second chamber, said second chamber providing a heat sink chamber to hold said mixture flowing from said outlets and allowing transfer of heat from said second chamber into said mixture reducing the temperature of said second chamber, said second chamber having a plurality of ports extending along said longitudinal axis to allow said mixture to escape from said burner to form an elongated strip of gas and air escaping through said ports.

8. The burner of claim 7 in addition comprising:

a pair of opposite flame directing walls on said tube with said ports extending therebetween, said walls are spaced apart forming a row, said walls direct said mixture flowing outwardly from said ports.

9. The burner of claim 7 wherein said first chamber is formed by a first elongated tube with a first cross section and a first longitudinal axis, and said second chamber is formed by a second elongated tube with a second cross section and a second longtudinal axis, said ports extending along said second longitudinal axis.

10. The burner of claim 9 in addition comprising:

a pair of opposite flame directing walls on said second elongated tube with said ports extending therebetween, said walls are spaced apart forming a row, said walls direct said mixture flowing outwardly from said ports.

11. A burner for flame treating a material web operable on a gas/air fuel mixture comprising:

a tube with a longitudinal axis and a partition along said longitudinal axis, said partition dividing said tube into a first chamber and a second chamber, said first chamber connectable to a source of said mixture, said first chamber having a plurality of outlets extending through said partition to permit a volume of said mixture to flow from said first chamber into said second chamber, said second chamber providing a heat sink chamber to hold said mixture flowing from said outlets and allowing transfer of heat from said second chamber into said mixture reducing the temperature of said second chamber, said second chamber having a plurality of ports extending along said longitudinal axis to allow said mixture to escape from said burner to form an elongated strip of gas and air escaping through said ports; and, wherein said first chamber is formed by a first elongated tube with a first cross section and a first longitudinal axis, and said second chamber is formed by a second elongated tube with a second cross section and a second longitudinal axis, said ports extending along said second longitudinal axis;

and wherein said first elongated tube is situated within said second elongated tube but spaced apart therefrom at the location of said outlets forming said heat sink chamber.

12. The burner of claim 11 in addition comprising:

a pair of opposite flame directing walls on said second elongated tube with said ports extending therebetween, said walls are spaced apart forming a row, said walls direct said mixture flowing outwardly from said ports.

13. A method of flame treating a material web facilitating adherence to said web comprising the steps of:

providing an elongated tube with length and ports along said length;

premixing sufficient air with gas to insure virtual complete combustion of the gas;

forcing a gas/air mixture through said ports at a minimum high velocity;

igniting said mixture to produce a flame along said length;

directing said flame toward and adjacent said material web to directly treat said web with said flame while said web moves across said flame; and moving said web past said flame at a web velocity equal to or greater than said minimum high velocity of said mixture controlling the position of said flame to treat substantially all flame facing surface of said web while minimizing flame/web dwell.

14. The method of claim 13 wherein said gas/air mixture is in a ratio ranging from 10 parts air: 1 part gas, to 30 parts air: 1 part gas.

15. The method of claim 13 wherein said gas/air mixture has a velocity ranging from 1,000 feet per minute to 100,000 feet per minute.

16. An apparatus for flame treating a material web comprising:

a frame;

a source of pressurized air;

a source of pressurized gas;

a burner of claim 11;

a valve means connected to said source of air and said source of gas operable to provide a lean fuel mixture of gas to air along said burner;

a conveying means supporting said material web operable to convey said material web past said burner and said flame; and an exhaust means connected to said conveying means operable to allow the removal of exhaust fumes.

17. An apparatus for flame treating a material web comprising:

a frame;

a source of pressurized air;

a source of pressurized gas;

a burner of claim 12;

a valve means connected to said source of air and said source of gas operable to provide a lean fuel mixture of gas to air along said burner;

a conveying means supporting said material web operable to convey said material web past said burner and said flame; and an exhaust means connected to said conveying means operable to allow the removal of exhaust fumes.

* * * * *